US007544109B2

(12) United States Patent
Lin

(10) Patent No.: US 7,544,109 B2
(45) Date of Patent: Jun. 9, 2009

(54) PROPELLING SYSTEM FOR BOAT

(75) Inventor: Yeun-Junn Lin, Taichung (TW)

(73) Assignee: Solas Science & Engineering Co., Ltd., Taichung (TW)

( * ) Notice: Subject to any disclaimer, the term of this patent is extended or adjusted under 35 U.S.C. 154(b) by 0 days.

(21) Appl. No.: 11/860,023

(22) Filed: Sep. 24, 2007

(65) Prior Publication Data

US 2008/0280514 A1 Nov. 13, 2008

(30) Foreign Application Priority Data

May 9, 2007 (TW) ..... 96116494 A

(51) Int. Cl.
*B63H 5/16* (2006.01)
*B63H 25/06* (2006.01)

(52) U.S. Cl. ..... 440/71; 114/162; 114/166

(58) Field of Classification Search ..... 114/162, 114/166; 440/71

See application file for complete search history.

(56) References Cited

U.S. PATENT DOCUMENTS 123,629 A * 2/1872 Hemje ..... 114/165
313,733 A * 3/1885 Heydt ..... 114/166
1,306,913 A * 6/1919 Kitchen ..... 114/145 R
1,475,695 A * 11/1923 Golden ..... 114/145 R
2,401,126 A * 5/1946 Weaver et al. ..... 114/61.3
2,483,675 A * 10/1949 Sheldon ..... 114/166
3,115,112 A * 12/1963 Erlbacher ..... 114/166

* cited by examiner

*Primary Examiner*—Lars A Olson
*Assistant Examiner*—Daniel V Venne
(74) *Attorney, Agent, or Firm*—Browdy and Neimark, P.L.L.C.

(57) ABSTRACT

A propeller system for a boat includes a housing adapted to be mounted to a stern of the boat and having a receiving chamber inside and waterway at the bottom side thereof, a propeller rotatably disposed in the waterway of the housing, a driving device mounted in the receiving chamber of the housing and having a driving member and a linking member pivotally coupled to the driving member, and a guide ring connected to the linking member of the driving device and located in the waterway of the housing in such a way that the guide ring surrounds the blades of the propeller and is pivotable relative to the propeller. Thus, the propelling system has the advantage of increasing the utilization of the internal space of the boat.

6 Claims, 11 Drawing Sheets

PROPELLING SYSTEM FOR BOAT

BACKGROUND OF THE INVENTION

1. Field of the Invention

The present invention relates generally to a propelling system for use in a boat and more specifically, to a propelling system that can broaden the usable internal space of the boat.

2. Description of the Related Art

FIG. 1 is a schematic drawing showing a propelling system equipped in a small boat 1 according to prior art. The middlebody of hull of the small boat 1 is installed with an engine 110 to which a driving shaft 120 is connected. The driving shaft 120 slantingly downward penetrates through the bottom 130 of a small boat 1 and is supported by an A-shaped frame 140 and then coupled with a propeller 150. Further, the small boat 1 is provided at a stern 160 thereof with a rubber 170.

Because the A-shaped frame 140, the rudder 170 and the propeller 150 are located under the bottom 130 of the small boat 1, these components not only cause relatively higher water drag to reduce the speed of the small boat 1, but also tend to bump a rock or a driftwood accidentally, resulting in damage of themselves. In addition, the engine 110 is generally mounted inside the small boat 1 at the middlebody or afterbody of the boat; therefore, the inside space of the small boat 1 around the middlebody or afterbody area may not be usable for other purpose, i.e. the usable inside space of the small boat 1 is restricted.

FIG. 2 a schematic drawing showing a propelling system equipped in a big yacht 2 according to another prior art. According to this design, the engine 210 is mounted in the middlebody inside the hull of the yacht 2, which limits the utilization of the internal space of the yacht 2, and the propeller 220 and the rudder 270 are located under the bottom of the yacht 2, which may easily hit a rock or hurt divers or the endangered species of marine fauna, such as manatee, or even resulting in that seaweed may be wound on the propeller 220 to be uprooted. Besides, when the yacht 2 would like to sail backward, the yacht 2 has to change its direction through bow thrusters 240 mounted to a bow 230 thereof and stern thrusters 260 mounted to a stern 250 thereof. The mechanisms of the bow thrusters 240 and the stern thrusters 260 will also occupy partial internal space of the yacht 2. Thus, it is desirable to provide a propelling system that eliminates the aforesaid drawbacks.

SUMMARY OF THE INVENTION

The present invention has been accomplished in view of the above-noted circumstances. It is therefore one objective of the present invention to provide a propelling system for a boat, which can increase the usable internal space of the boat.

It is another objective of the present invention to provide a propelling system for a boat, which can change direction of the boat when it sails forward or backward.

It is still another objective of the present invention to provide a propelling system for a boat, which can reduce water drag when the boat sails forward.

It is further still another objective of the present invention to provide a propelling system for a boat, which can protect divers and the endangered species of marine fauna and flora from damage.

To achieve these objectives of the present invention, the propelling system for a boat comprises a housing, a propeller, a driving device and a guide ring. The housing is adapted for mounting to a stern of the boat and has a receiving chamber inside and a waterway at a bottom side thereof. The propeller is rotatably disposed in the waterway of the housing. The driving device is mounted in the receiving chamber of the housing and has a driving member and a linking member pivotally coupled to the driving member. The guide ring is connected to the linking member of the driving device and located in the waterway of the housing in such a way that the guide ring surrounds blades of the propeller and is pivotally moveable relative to the propeller by the actuation of the driving member through the linking member.

Since the housing, driving device, propeller and guide ring of the propelling system of the present invention can be disposed outside the stern of the boat rather than inside the boat, the usable internal space of the boat increases. In addition, by means of pivoting the guide ring relative to the propeller, the sailing direction of the boat can be controlled. Further, the bottom of the guide ring can be set in flush with the bottom of hull of the boat so as to reduce water drag when the boat sails and protect divers and the endangered species of marine fauna and flora from directly hitting by the propeller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 7:
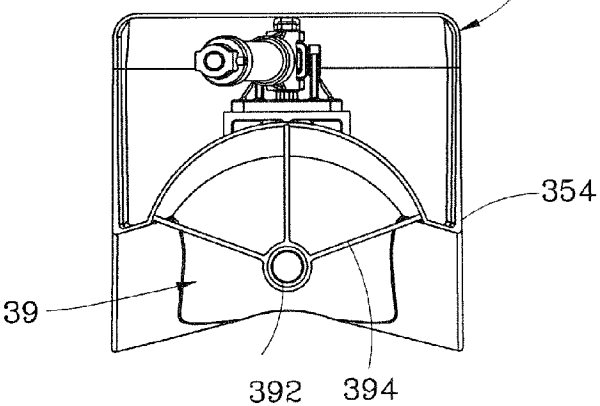
FIG. 7 is a sectional view taken along line 7-7 of FIG. 4.
Figure 6:
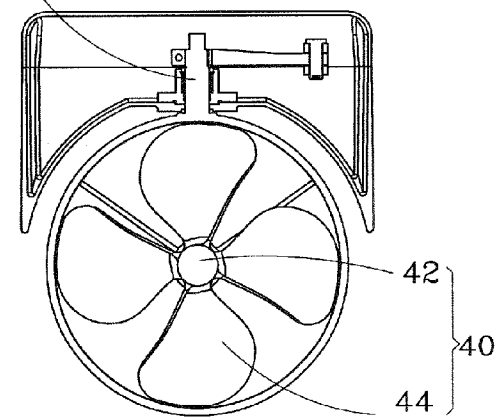
FIG. 6 is a sectional view taken along line 6-6 of FIG. 4.
Figure 8:
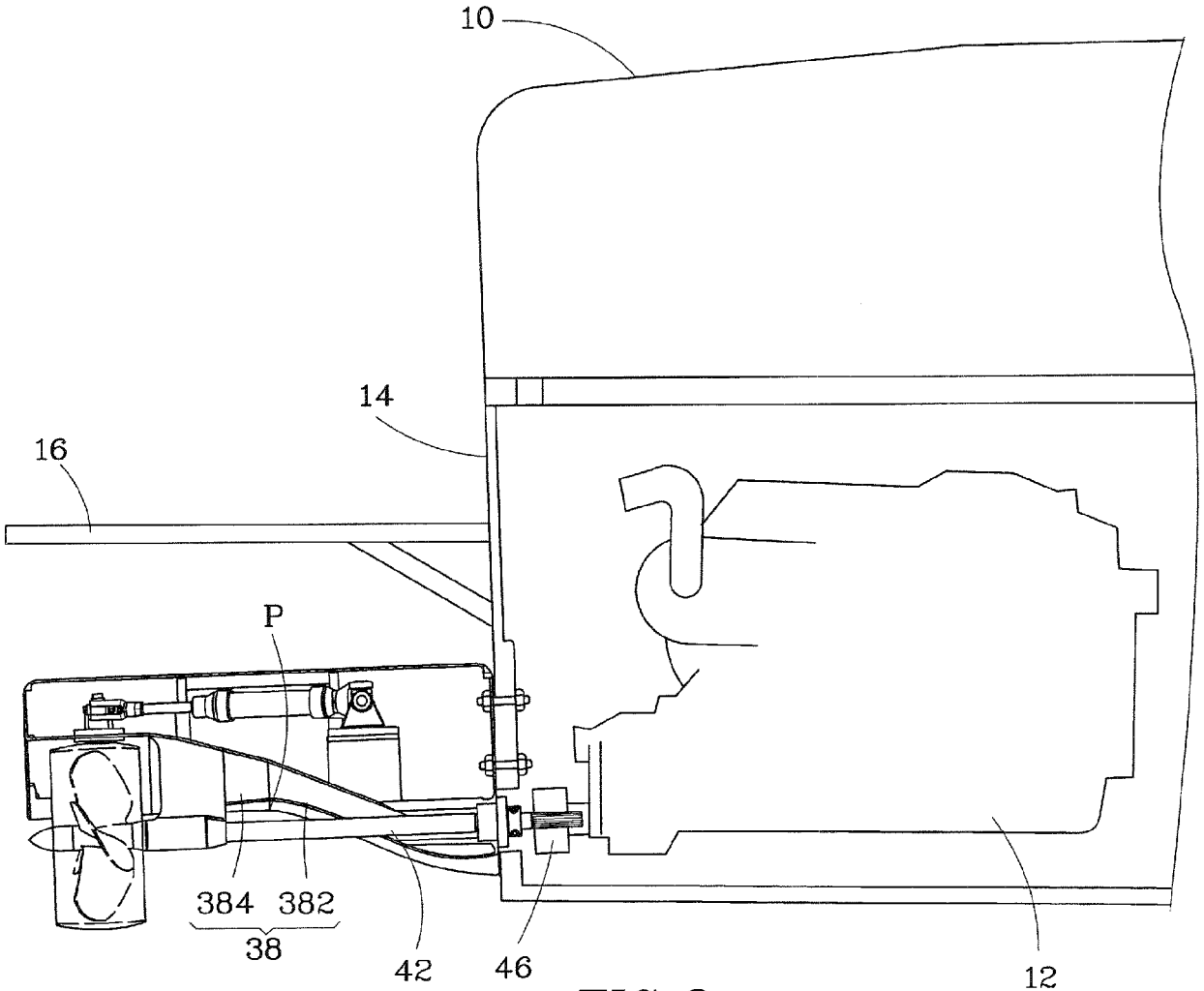
FIG. 8 is a schematic drawing showing that the propelling system of the present invention is installed in a small boat.

Referring to FIG. 3 to FIG. 8, a propelling system 20 in accordance with a preferred embodiment of the present invention comprises a housing 30, a propeller 40, a hydraulic driving device 50 and a guide ring 60. As shown in FIG. 8, the propelling system 20 is installed in a small boat having a hull 10, an engine 12 mounted inside the hull 10 near a stem 14 of the hull 10 and a deck 16 fixed to the stern 14 of the hull 10.

The housing 30 has a front end thereof affixed to the stern 14 of the hull 10 of the small boat and is located under the deck 16 of the hull 10 of the small boat, as shown in FIG. 8. The housing 30 includes a base 34 and a lid 32 covered on a top side of the base 34 to define a receiving chamber 36 therebetween. The base 34 has two sidewalls 35*a* and 35*b*, each of which has a first section 352 extending slantingly from a front end of the base 34 to a position P located at the middle of the sidewalls 35*a* or 35*b*, and a second section 354 extending horizontally from the position P to a rear end of the base 34 such that the rear end of tile base 34 is higher in elevation than the front end of the base 34. Further, the base 34 is provided at a bottom side thereof with a semicircular waterway 38, which has an inclined section 382 defining between the first sections 352 of the sidewalls 35*a* and 35*b* of the housing 30 and a horizontal section 384 defining between the second sections 354 of the sidewalls 35*a* and 35*b* of the housing 30. Furthermore, as shown in FIG. 7, the housing 30 includes a supporting member 39 having a shaft sleeve 392 and three ribs 394, each of which is connected with the shaft sleeve 392 and a periphery wall of the waterway 38.

Figure 5:
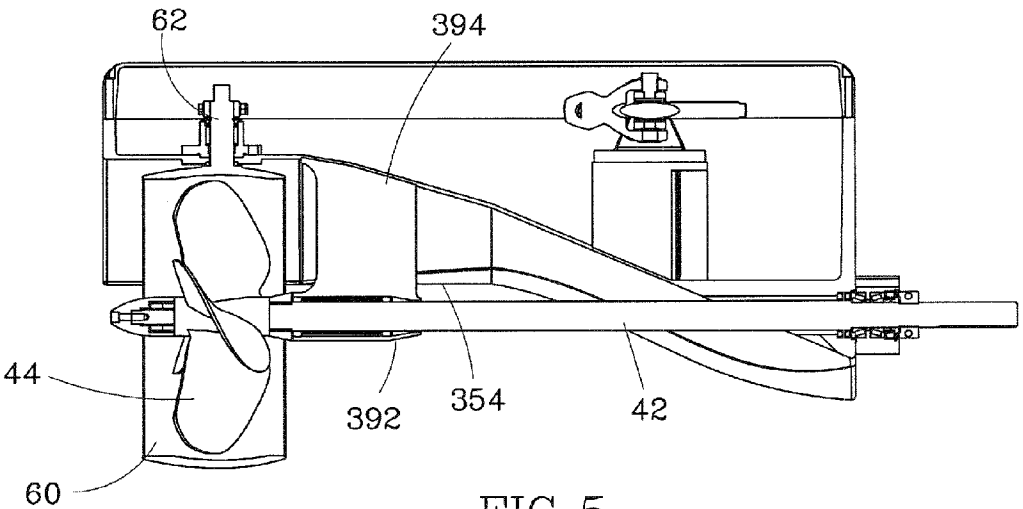
FIG. 5 is a sectional view taken along line 5-5 of FIG. 4.

Referring to FIG. 5 and FIG. 8, the propeller 40 has a hub on which a plurality of blades 44 are provided. One end of a shaft 42 passes through the shaft sleeve 392 of the supporting member 39 and then coupled with the hub, and the other end of the shaft 42 penetrates through the front end of the housing 30 and then coupled with engine 12 of the small boat through a shaft coupling 46 such that the blades 44 can be driven to rotate by the engine 12 through the shaft 42. The shalt 42 is located in the waterway 38 and lower in elevation than the second sections 354 of the sidewalls 35*a* and 35*b* of the housing 30, and the blades 44 are located at the horizontal section 384 of the waterway 38 and close to the rear end of the housing 30.

Figure 1:
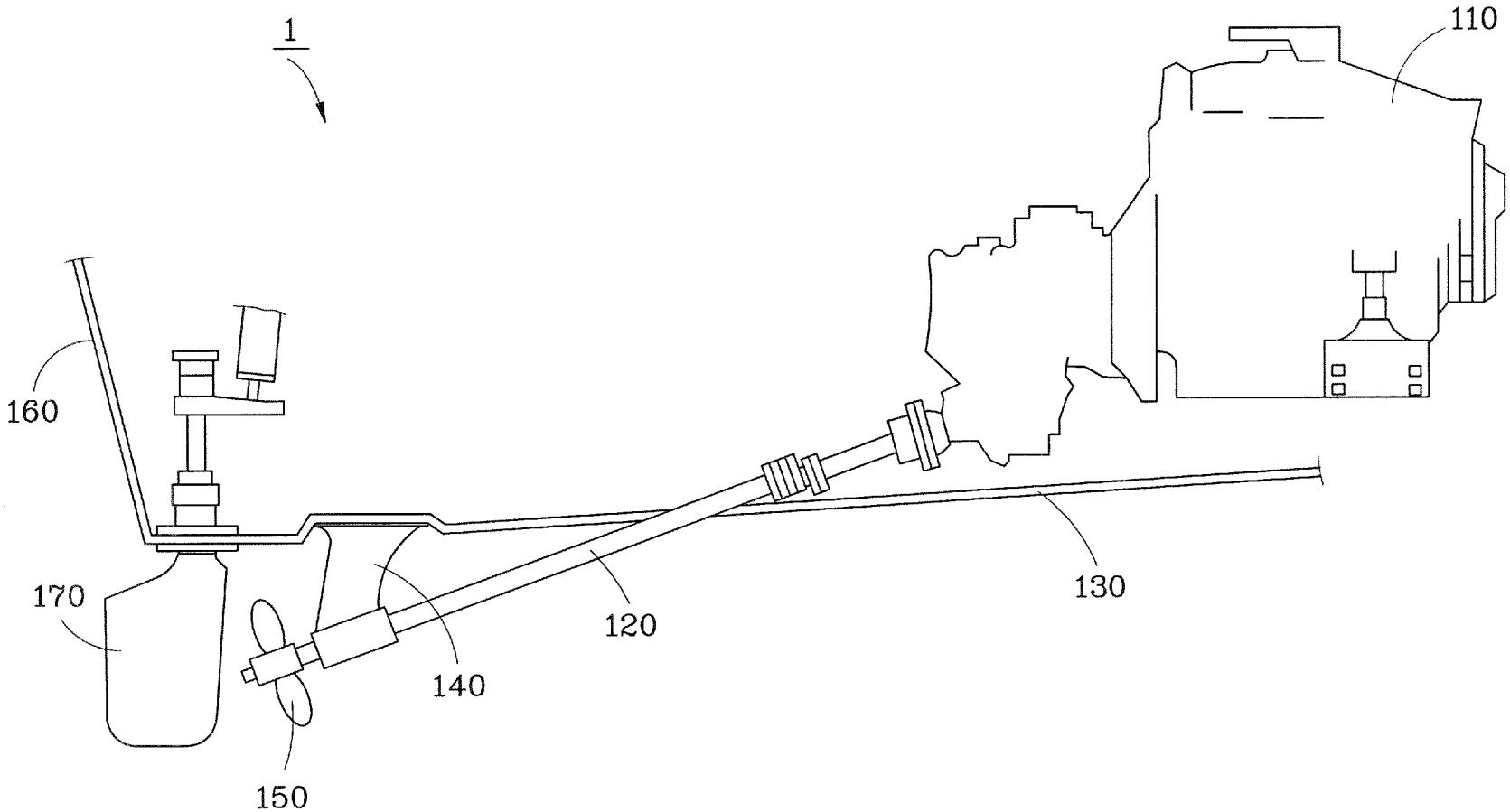
FIG. 1 PRIOR ART
FIG. 1 is a schematic drawing showing a propelling system equipped in a small boat according to a prior art.
Figure 2:
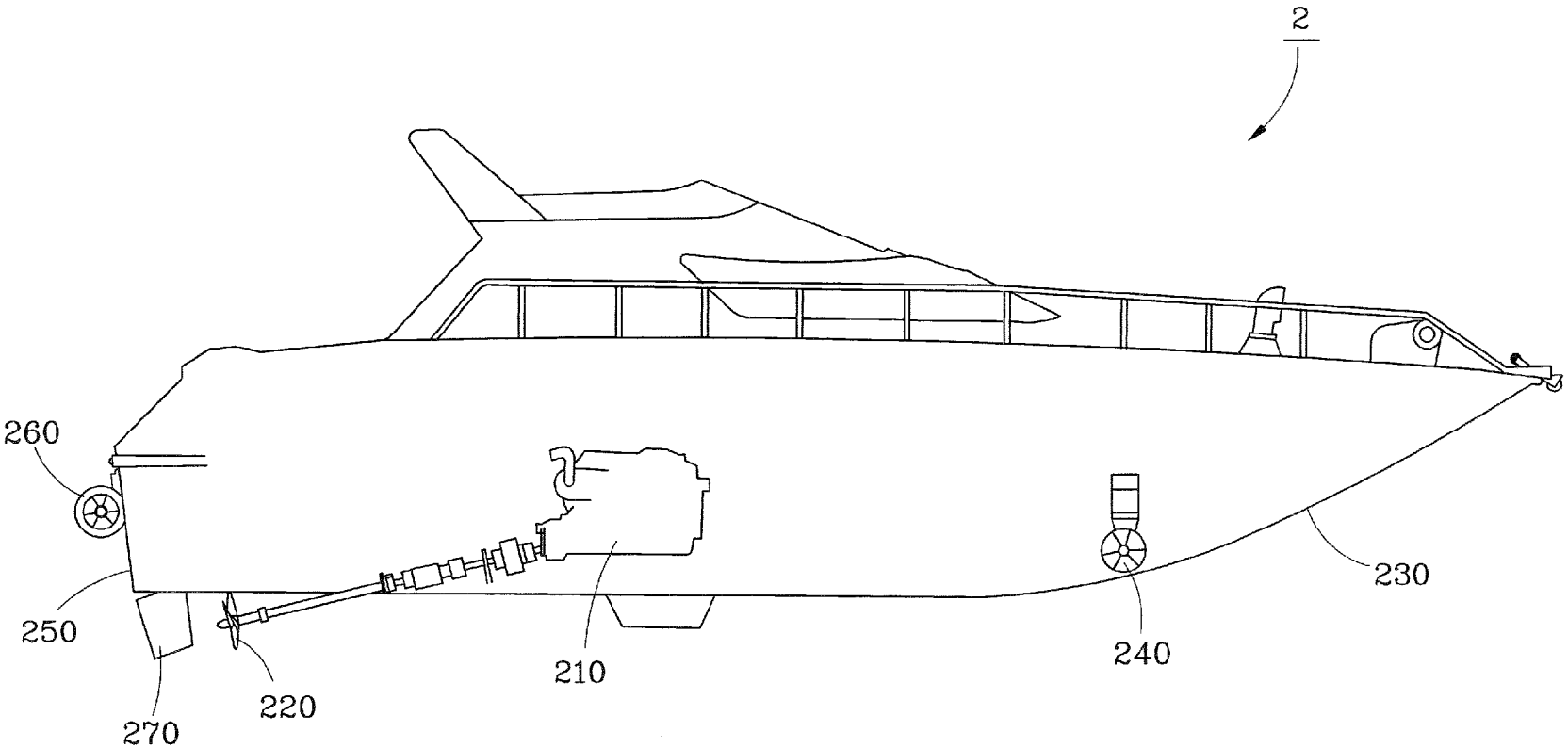
FIG. 2 PRIOR ART
FIG. 2 is a schematic drawing showing a propelling system equipped in a yacht according to a prior art.
Figure 3:
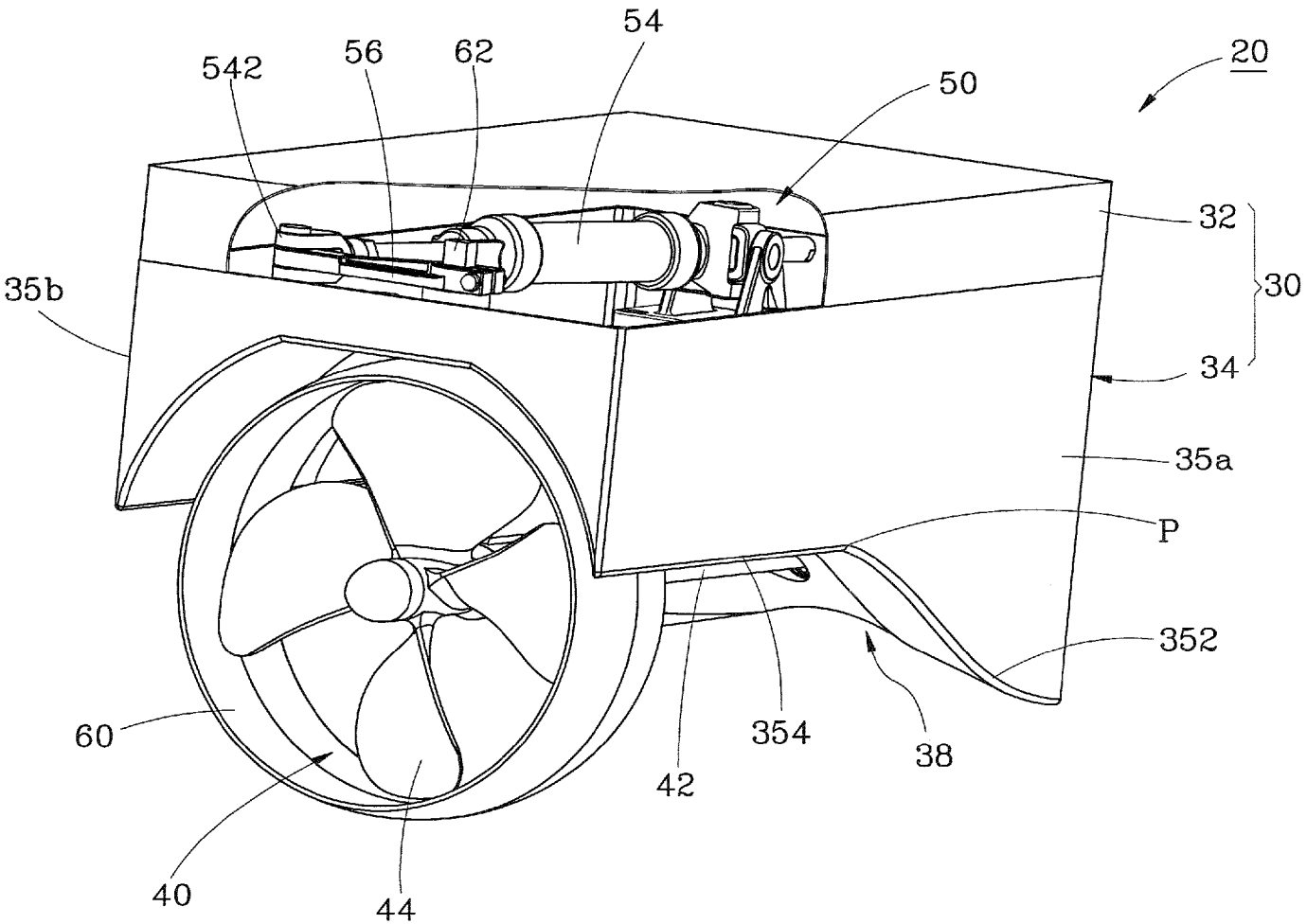
FIG. 3 is a perspective view of a propelling system according to a preferred embodiment of the present invention.
Figure 4:
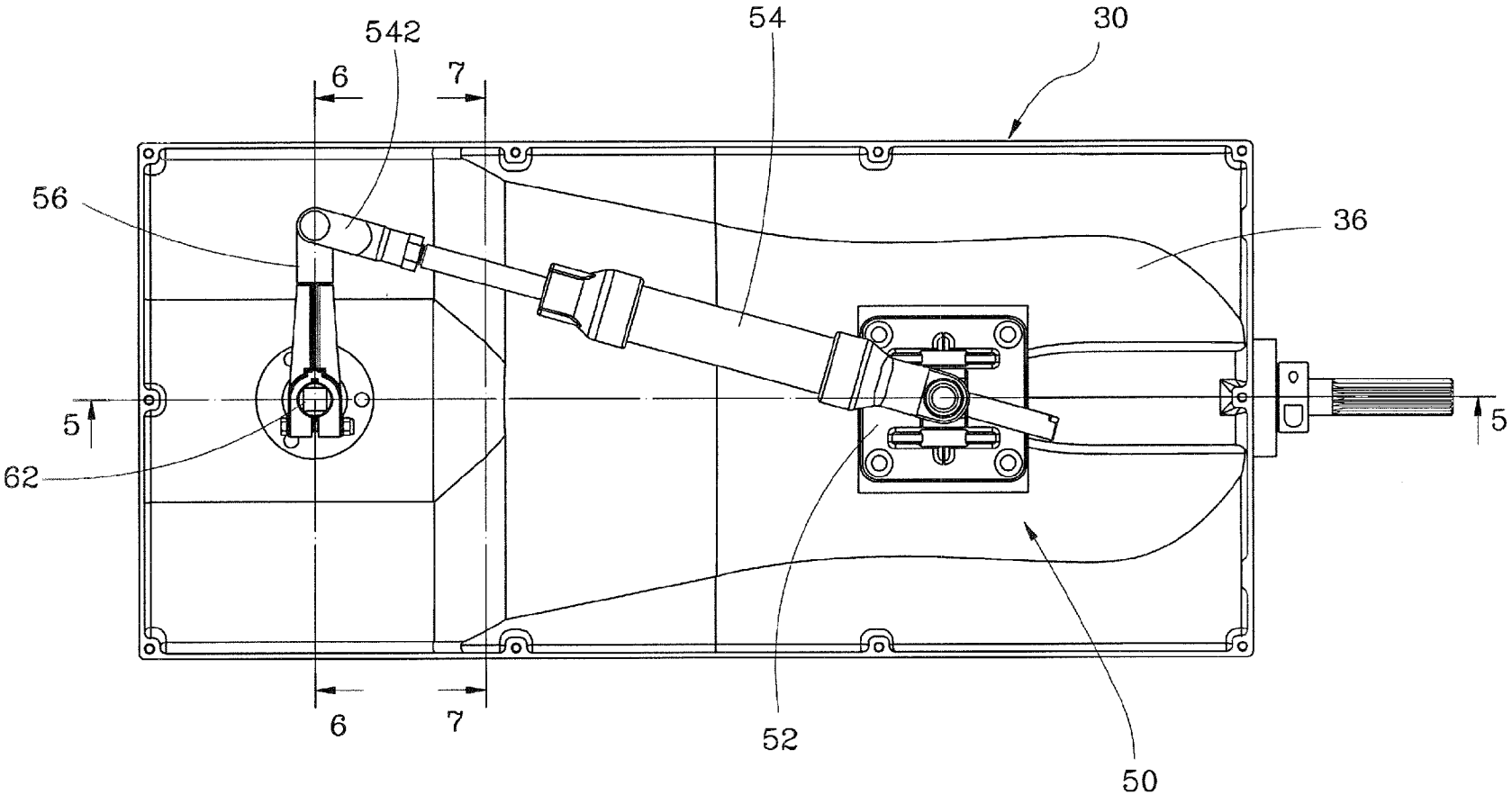
FIG. 4 is a top view of the propelling system according to the preferred embodiment of the present invention.

Referring to FIG. 4, the hydraulic driving device 50 includes a casing 52 installed inside the receiving chamber 36 of the housing 30, a hydraulic driving member 54, which is a cylinder in this embodiment and mounted to the casing 52 and electrically connected with a steering system (not shown), and a linking member 56 pivotally connected to the hydraulic driving member 54 through a joint 542 at a distal end of the linking member 56.

Figure 10:
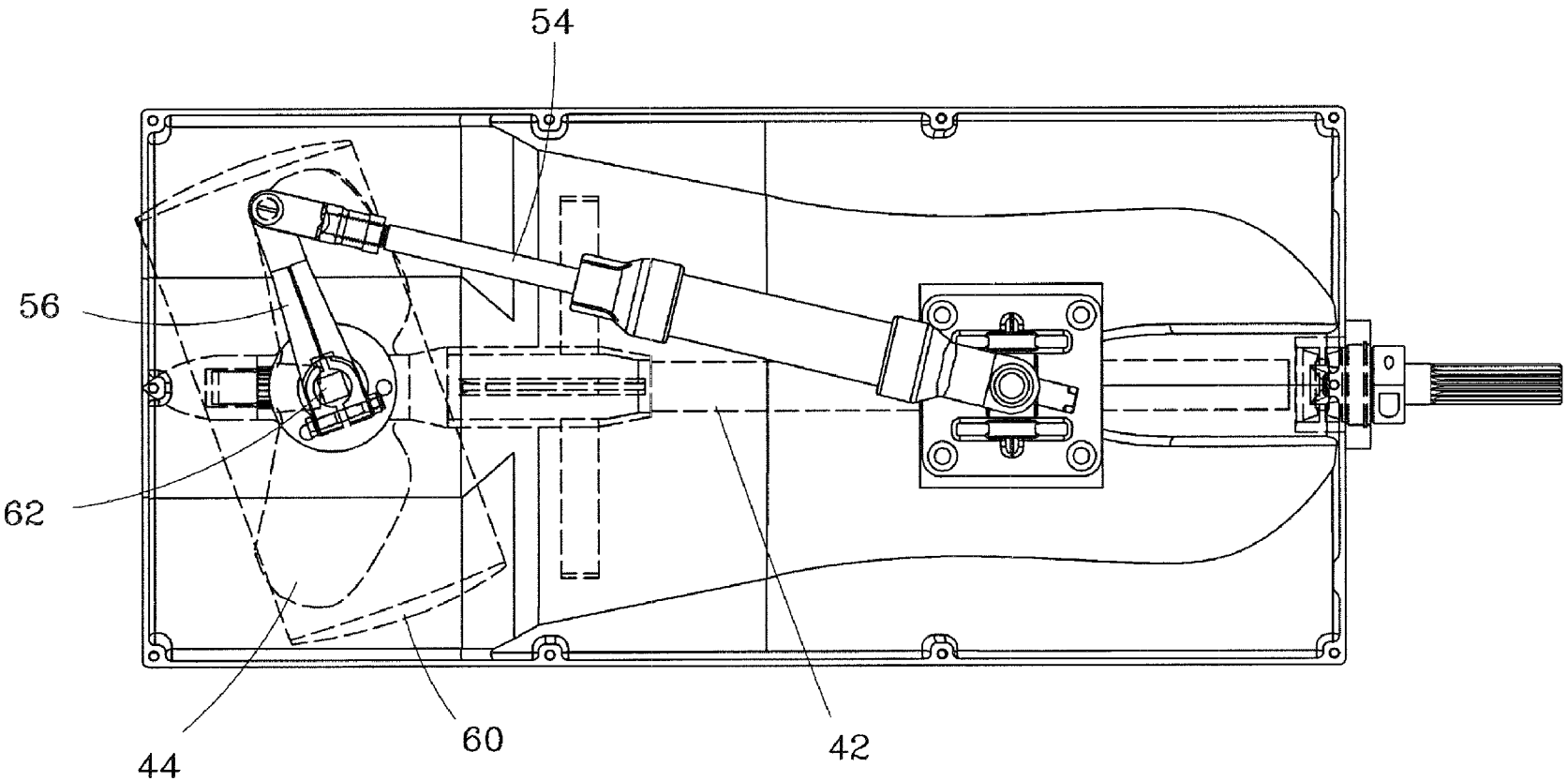
FIG. 10 is a top view of the propelling system according to the preferred embodiment of the present invention, showing that the guide ring is turned counterclockwise.
Figure 13:
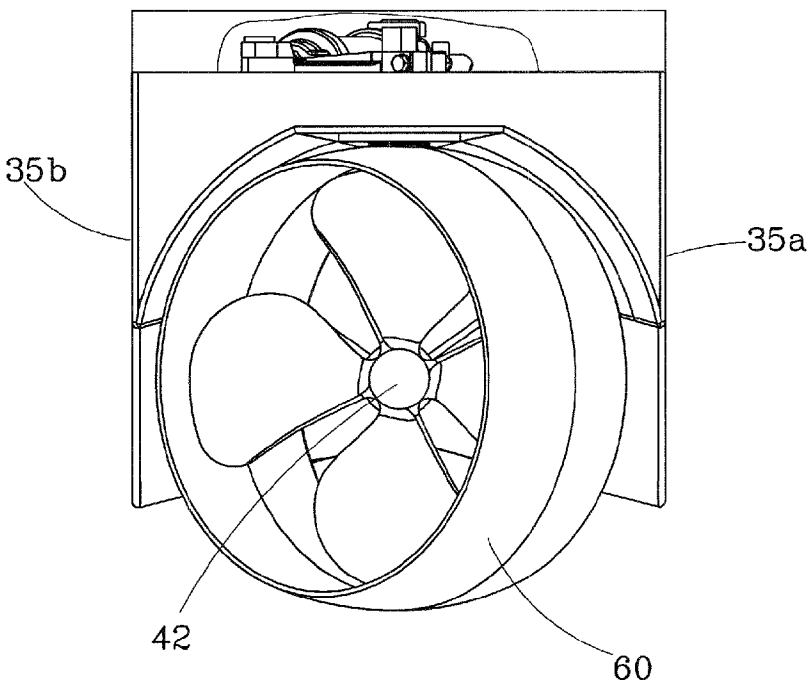
FIG. 13 is an end view of FIG. 12.
Figure 11:
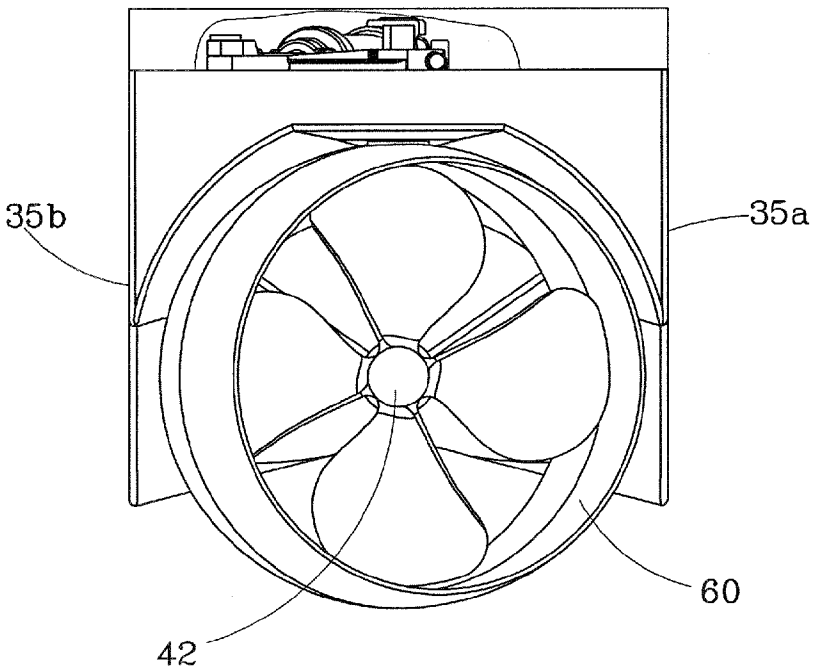
FIG. 11 is an end view of FIG. 10.
Figure 12:
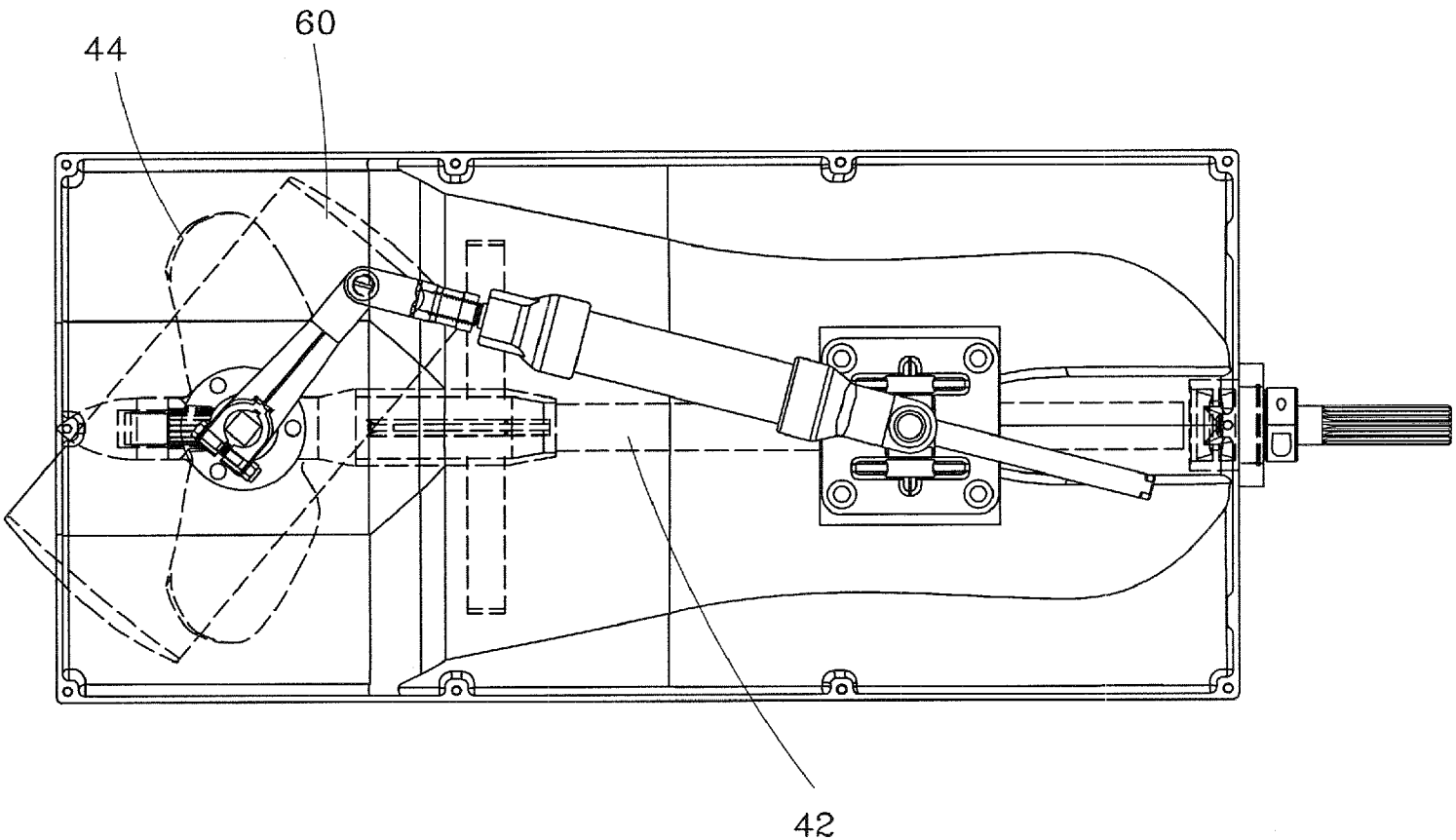
FIG. 12 is similar to FIG. 10 but showing that the guide ring is turned clockwise.

The guide ring 60 is located in the waterway 38 of the housing 30 and connected to the linking member 56 of the hydraulic driving device 50 through a shaft 62 in such a way that a guide ring 60 surrounds the blades 44 of the propeller 40 and is pivotable about the shaft 62 counterclockwise and clockwise from the view point of FIGS. 10 and 12 by the actuation of the driving member 54 through the linking member 56 for deflection rightward and leftward within an angle of 45 degrees in each way relative to the blades 44 of the propeller 40, as shown in FIGS. 11 and 13.

By means of the aforesaid design, the engine 12 can be installed inside the hull 10 near the stern 14 of the small boat and use diesel such that the hull 10 provides a big internal space for use. Moreover, although the engine 12 is installed inside the hull 10 near the stern 14 of the small boat, the housing 30 can increase (location of the stern 14 of the small boat to prevent the stern 14 of the small boat overweight. Besides, the bottom side of the guide ring 60 is substantially flush with the bottom of the hull 10, i.e. the small boat can be deemed as a flat-bottomed boat, for reducing water resistance when the small boat moves forward. Further, the small boat is suitable for use in a shallow area and won't easily hit a rock or hurts divers or the endangered species of marine fauna and flora.

Furthermore, when the propeller 40 is rotated, water will be sucked from the inclined section 382 of the waterway 38 of the housing 30 into the horizontal section 384 of the waterway 38 of the housing 30, and then ejected out of the rear end of the housing 30 through the guide ring 60 to propel the small boat forward. When the small boat would like to be turned to the right, a boat driver can start the hydraulic driving member 54 through the steering system such that the guide ring 60 can be driven by the linking member 56 to turn to the right, as shown in FIGS. 10 and 11, thereby causing water to be ejected toward the right. Thus, the small boat will be turned to the right. On the contrary, when the guide ring 60 is driven by the linking member 56 to turn to the left, as shown in FIGS. 12 and 13, water will be ejected toward the left, thereby causing the small boat to be turned to the left.

When the boat driver wants to steer the small boat backward, the propeller 40 has to be rotated reversely to suck water into the waterway 38 of the housing 30 through the guide ring 60. Under this circumstance, because the second sections 354 of the sidewalls 35*a* and 35*b* of the housing 30 are higher in elevation than the shaft 42 of the propeller 40, water is sucked into the waterway 38 and then ejected out of the second sections 354 of the side walls 35*a* and 35*b* of the housing 30. Therefore, when the guide ring 60 is turned to the left, as shown in FIGS. 12 and 13, water is ejected out of the second section 354 of the side walls 35*a* of the housing 30, thereby causing the stern 14 of the small boat to be turned to the left. On the contrary, when the guide ring 60 is turned to the right, as shown in FIGS. 10 and 11, water is ejected out of the second section 354 of the side walls 35*b* of the housing 30, thereby causing the stem 14 of the small boat to be turned to the right.

Figure 9:
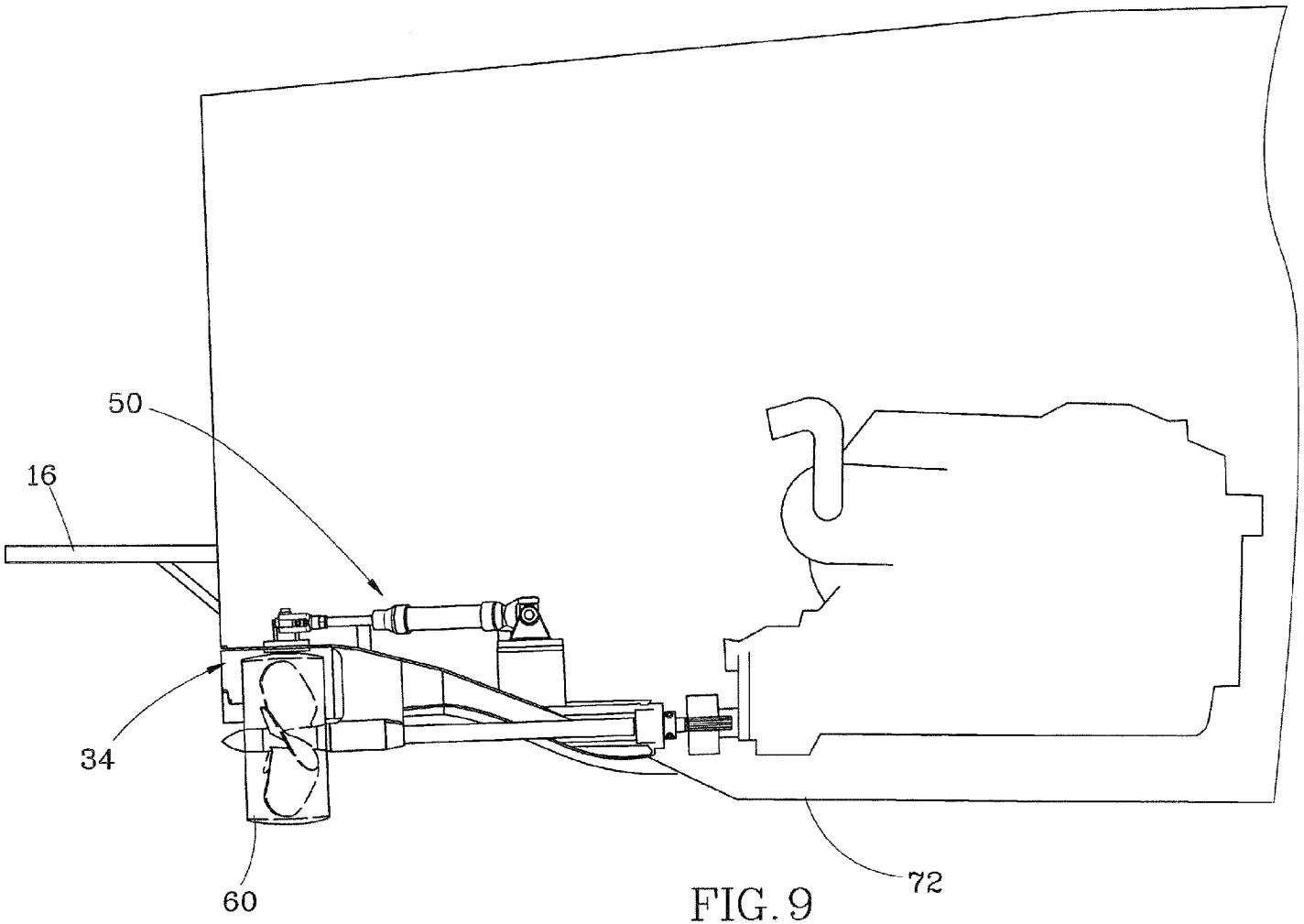
FIG. 9 is a schematic drawing showing that the propelling system of the present invention is installed in a big boat.

Further, the propelling system 20 of the present invention also can be mounted to a big boat, as shown in FIG. 9. A top side of the base 34 of the housing 30 is directly fixed to the bottom 72 of the big boat without using the lid 32 for enabling the hydraulic driving device 50 to be located inside the big boat. As a result, the bottom side of the guide ring 60 can be still maintained flush with the bottom 72 of the big boat, thereby achieving the objectives of the present invention.

Figure 14:
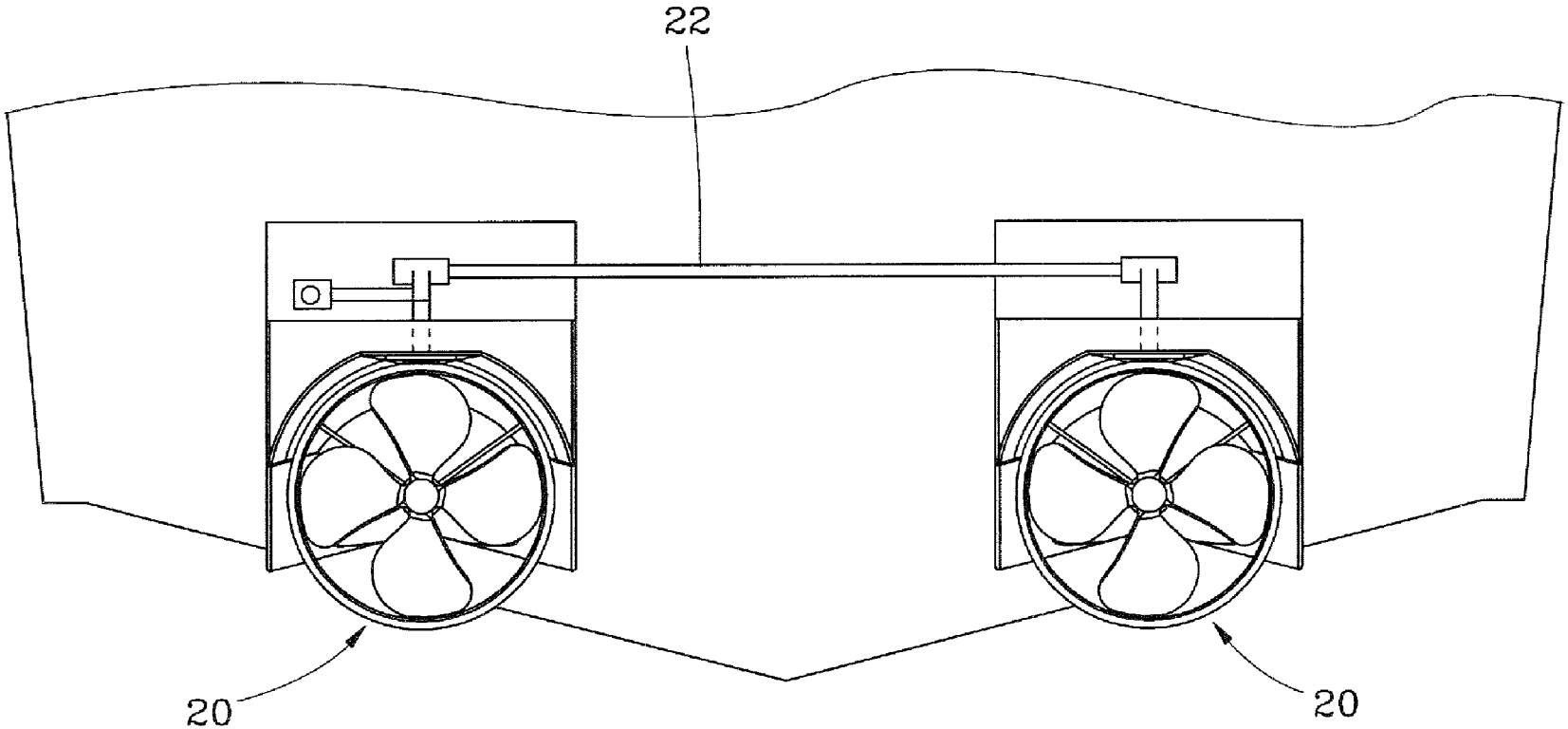
FIG. 14 is a schematic drawing showing that two propelling systems according to the preferred embodiment of the present invention are bilaterally installed at the stem of a boat.

In addition, FIG. 14 shows another application of the propelling system of the preferred embodiment of the present invention. Two propelling systems 20 are symmetrically mounted at two sides of the stern to provide a high propelling force. The propelling systems 20 can be operated respectively or synchronously through a connecting member 22.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A propelling system for a boat having a stern, the propelling system comprising:

a housing for mounting to the stern of the boat, the housing having a receiving chamber inside and a waterway at a bottom side thereof;

a propeller rotatably disposed in the waterway of the housing, the propeller having a plurality of blades;

a driving device mounted in the receiving chamber of the housing and having a driving member and a linking member pivotally coupled to the driving member;

a guide ring connected to a linking member of the driving device and located in the waterway of the housing such that the guide ring surrounds the blades of the propeller and is pivotable relative to the propeller;

wherein the housing includes two sidewalls, each of which has a rear end thereof higher in elevation than a front end thereof;

the waterway of the housing is defined between the two sidewalls of the housing; and wherein each sidewall of the housing has a first section slantingly and backwardly extending from the front end thereof, and a second section integrally connected with the first section and horizontally extending from the first section of the rear end thereof.

2. The propelling system as claimed in claim 1, wherein the waterway of the housing has an inclined section between the first sections of the sidewalls of the housing, and horizontal section between the second sections of the sidewalls of the housing.

3. The propelling system as claimed in 1, wherein the housing includes a base having said sidewalls and said waterway, and a lid covering a top side of the base to define said receiving chamber between the lid and the base.

4. The propelling system as claimed in claim 1, wherein the guide ring has a shaft connected to the linking member of the driving device such that the guide ring is pivotable about the shaft by the actuation of the driving member through the linking member.

5. The propelling system claimed in claim 4, wherein the guide ring is pivotable about the shaft for deflection leftward and rightward within an angle of 45 degrees.

6. The propelling system claimed in claim 1, further comprising a supporting member having shaft sleeve for inserting a shaft of the propeller and a plurality of ribs respectively affixed to the shaft sleeve and a periphery wall of the waterway of the housing.

* * * * *